US005684761A

United States Patent [19]

Chen et al.

[11] Patent Number: 5,684,761

[45] Date of Patent: Nov. 4, 1997

[54] SWINGING TYPE POWER GENERATOR

[75] Inventors: Shih-Chou Chen; Tung-Chuan Wu, both of Hsinchu; Chen-Sheng Weng, Hsinchu Hsien; Ray-Ten Chen, Tsupei; Chang-Chun Chen, Chia-Yi, all of Taiwan

[73] Assignee: Industrial Technology Research Institute, Hsinchu, Taiwan

[21] Appl. No.: 594,667

[22] Filed: Feb. 2, 1996

[51] Int. Cl.[6] ..... G04B 27/12; G04C 3/00

[52] U.S. Cl. ..... 368/204; 368/64; 368/179

[58] Field of Search ..... 368/203, 204, 368/64, 66, 149, 179; 320/21; 322/10

[56] References Cited

U.S. PATENT DOCUMENTS

| | | | |
|---|---|---|---|
| 4,008,566 | 2/1977 | McClintock | 368/64 |
| 4,644,246 | 2/1987 | Knapen | 368/64 |
| 5,278,806 | 1/1994 | Affolter | 368/204 |

*Primary Examiner*—Bernard Roskoski
*Attorney, Agent, or Firm*—W. Wayne Liauh

[57] ABSTRACT

An improved swinging type generator for use in automatic wrist watches is disclosed. It contains: (a) a base with a center shaft hole, (b) a stator mounted on the base containing at least one layer of ring-shaped coil plate having at least one periodic-wave-shaped induction coil arranged on and along a circumference of the ring-shaped coil plate; (c) an unbalanced-and-weighted swinging magnetic rotor having a central rotary shape. The rotary shaft is mounted in the shaft hole of the base, and the unbalanced-and-weighted swinging magnetic rotor includes a magnetic ring having a plurality of magnets arranged in a head-to-tail manner along a circumference of the magnetic ring. In a preferred embodiment the induction coil has the shape of a multiple-cycle square-wave, and the angle of the square wave equals the magnetic angle, which is the angle formed between half of the arc length of an individual magnet of the magnetic ring and the center of the shaft hole, so as to maximize the electro-motive force that can be generated.

4 Claims, 6 Drawing Sheets

SWINGING TYPE POWER GENERATOR

BACKGROUND OF THE INVENTION

1. Field of the Invention

This invention relates to a swinging type electricity generator, and particularly to a swinging type of generator to be used in a wrist watch.

2. Description of the Prior Art

Currently, the generator of some wrist watches can generate an electric power upon a user's hand swinging during walking. During the shortage of energy at the present time, such generator can save consumption of the existing energy source so as to have the existing energy used efficiently.

The theory of generating electric power with a generator is based on the Fleming right-hand rule, i.e., using a stator winding to cut the magnetic lines of force of a magnet to generate an electro-motive force. Generally, the stator winding of a generator moves relatively to a single magnetic pole to generate a sine wave voltage; however, the effective value of a sine wave voltage is low, i.e., the effective power of such a generator is limited.

The conventional swinging type of generator in a wrist watch includes an unbalanced-and-weighted swinging rotor, a set of acceleration gears, a stator winding and magnets. This type of generator has drawbacks as follows:

(a). Having a complex structure (as a result of the acceleration gears).

(b). Having larger size (when a wrist watch requires large current).

(c). Having a low efficiency (as a result of generating a sine wave voltage).

Therefore, the prime object oft he present invention is to provide an improved generator for a wrist watch so as to overcome the drawbacks of conventional generators that are used in wrist watches.

When a reader read the following description, he (or she) should also refer to the drawings attached herewith so as to have a better understanding of the result and objects of the present invention.

SUMMARY OF THE INVENTION

The prime object of the present invention is to provide a swinging type generator, which comprises a base, at least one layer of stator winding, and an unbalanced-and-weighted swinging magnetic rotor. The center of the base has a shaft hole; the stator winding is mounted on the base; the stator winding includes at least a layer of coil plate, which has at least one turn of induction coil to generate a cycle of wave form. The output terminals of the induction coil are connected with a set of lead-out wires. The center of the unbalanced-and-weighted swinging magnetic rotor has a rotary shaft to be fitted in a shaft hole on the base; between the stator winding and the magnetic rotor, there is a clearance so as to facilitate the magnetic rotor and the stator winding to move relatively. The edge of the unbalanced-and-weighted swinging magnetic rotor is mounted with a magnet ring made of a plurality of magnets. As soon as the unbalanced-and-weighted swinging magnetic rotor swings, the induction coil of the stator winding will cut the magnetic lines of force of the magnet ring to generate an electro-motive force.

DETAILED DESCRIPTION

Figure 1:
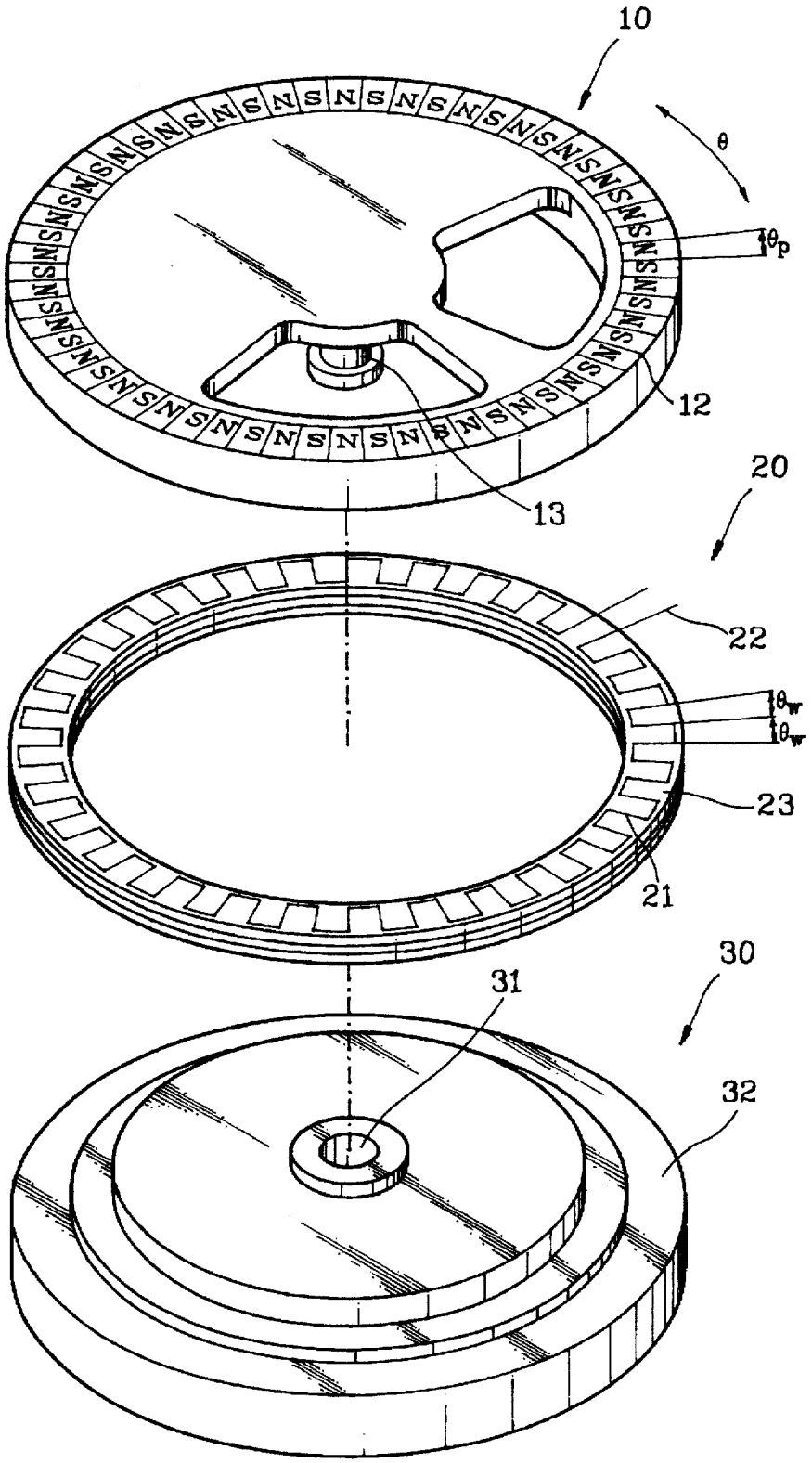
FIG. 1 is a disassembled view of a swinging type generator according to the present invention.
Figure 2A:
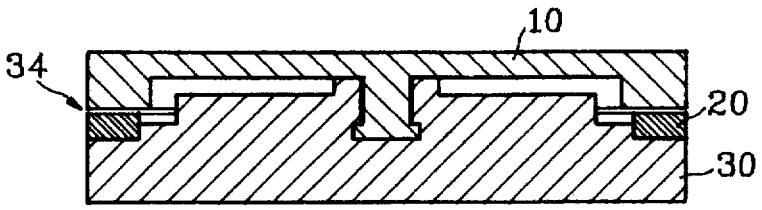
FIG. 2A is a sectional view of the present invention.
Figure 3:
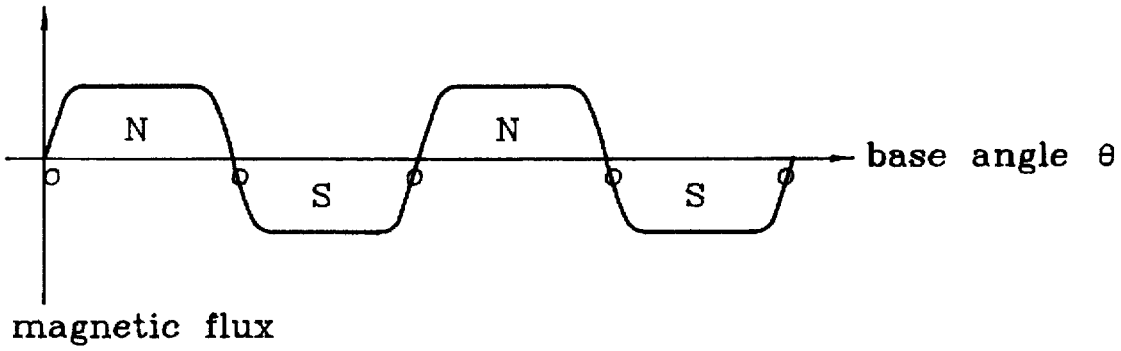
FIG. 3 illustrates the magnetic flux change along the rotation angle of the magnet ring according to the present invention.
Figure 2B:
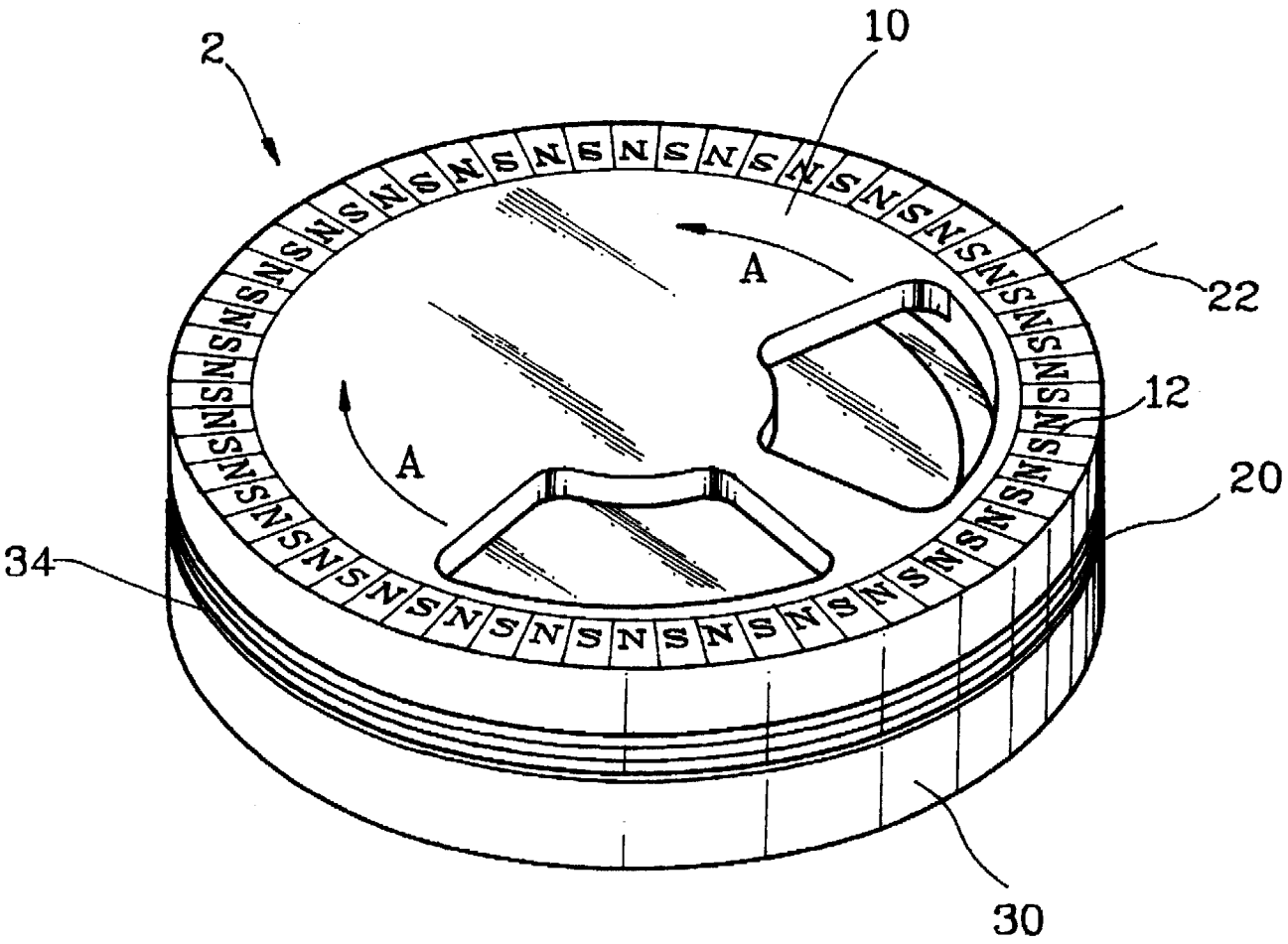
FIG. 2B is a perspective view of the present invention.

Referring to FIGS. 1, 2A and 2B, the swinging type pulse generator 2 according to the present invention comprises a base 30, a stator winding 20, an unbalanced-and-weighted swinging magnetic rotor 10. The base 30 includes a shoulder portion 32 and a shaft hole 31 in the center thereof; the stator winding 20 is to be mounted on the shoulder portion 32. The stator winding includes at least a layer of coil plate 23, which is mounted with at least an induction coil 21 to be connected in series with other coils. Such inducting coils can be a printed circuit board made by means of an etching method. The output terminal of the induction coil 21 is connected with two lead-out wires 22. The center of the unbalanced-and-weighted swinging magnetic ring 10 is mounted with a rotary shaft 13 mounted in the shaft hole 31 in the base 30. Between the magnetic ring 10 and the stator winding 20, there is a clearance 34 so as to enable the two parts to have a relative swinging motion (as shown in FIG. 2A). The edge part of the unbalanced-and-weighted swinging magnetic rotor 10 is famished with a magnet ring 12 made of a multi-pole permanent magnet; as shown in FIG. 1, the edge of each magnetic pole (N or S pole) has an angle θ p. The magnetic strength along the rotor angle θ of the magnet ring 12 provides a square-wave-shaped magnetic flux change (as shown in FIG. 3).

Figure 4A:
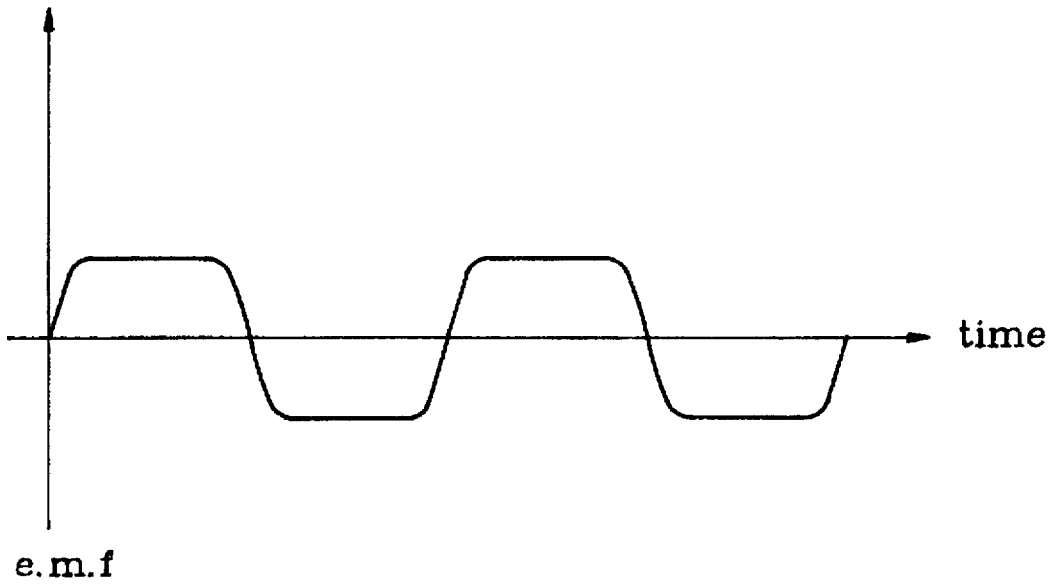
FIG. 4A illustrates the voltage wave form generated with the present invention.
Figure 4B:
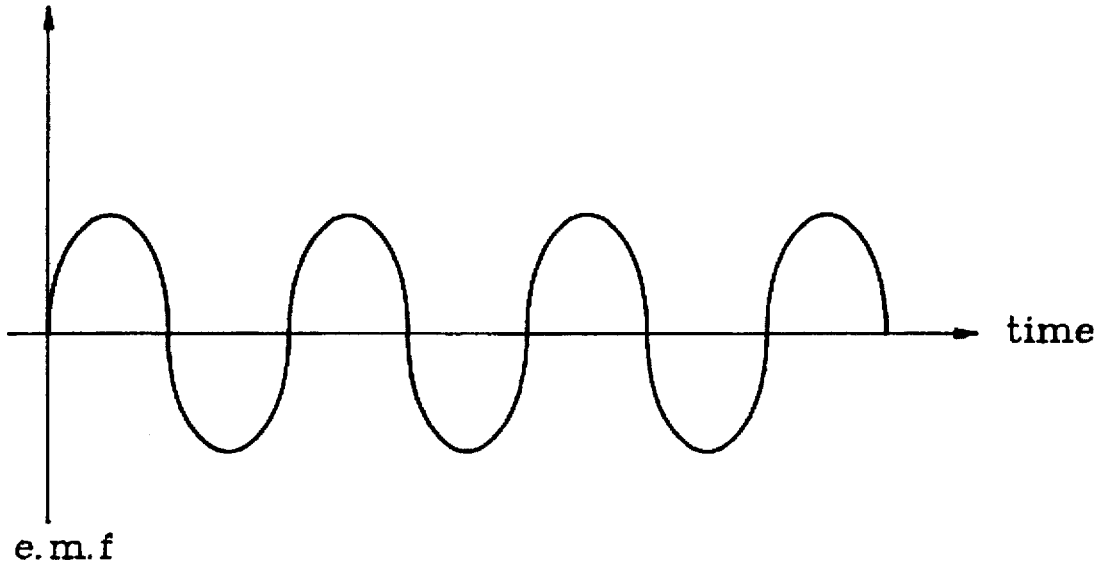
FIG. 4B illustrates a typical voltage wave form generated with a conventional generator.

Referring to FIG. 1 again, the induction coil 21 includes a plurality of square-wave-shaped coils, of which each has a coil angle θ w, being equal to the magnet angle θ p; therefore, the area of each magnet (N or S pole) is approximately equal to that of the square-wave-shaped coil. As soon as the unbalanced-and-weighted swinging magnetic rotor 10 swings when the person wearing the wrist watch moves his wrist (as shown with an arrow A in FIG. 2B), the magnet ring 12 will move relatively to the stator winding 20 to cause the induction coil 21 on the stator winding 20 to generate an electro-motive force. As mentioned above, since the magnet ring 12 on the rotor 10 can move relative to the stator winding 20, and the magnet angle θ p is equal to the coil angle θ w, the induction coil 21 can generate a square-wave-shaped electro-motive force (as shown in FIG. 4A); the aforesaid feature of the present invention is clearly different from the conventional generator, which usually generates a sine wave (as shown in FIG. 4B).

Figure 5:
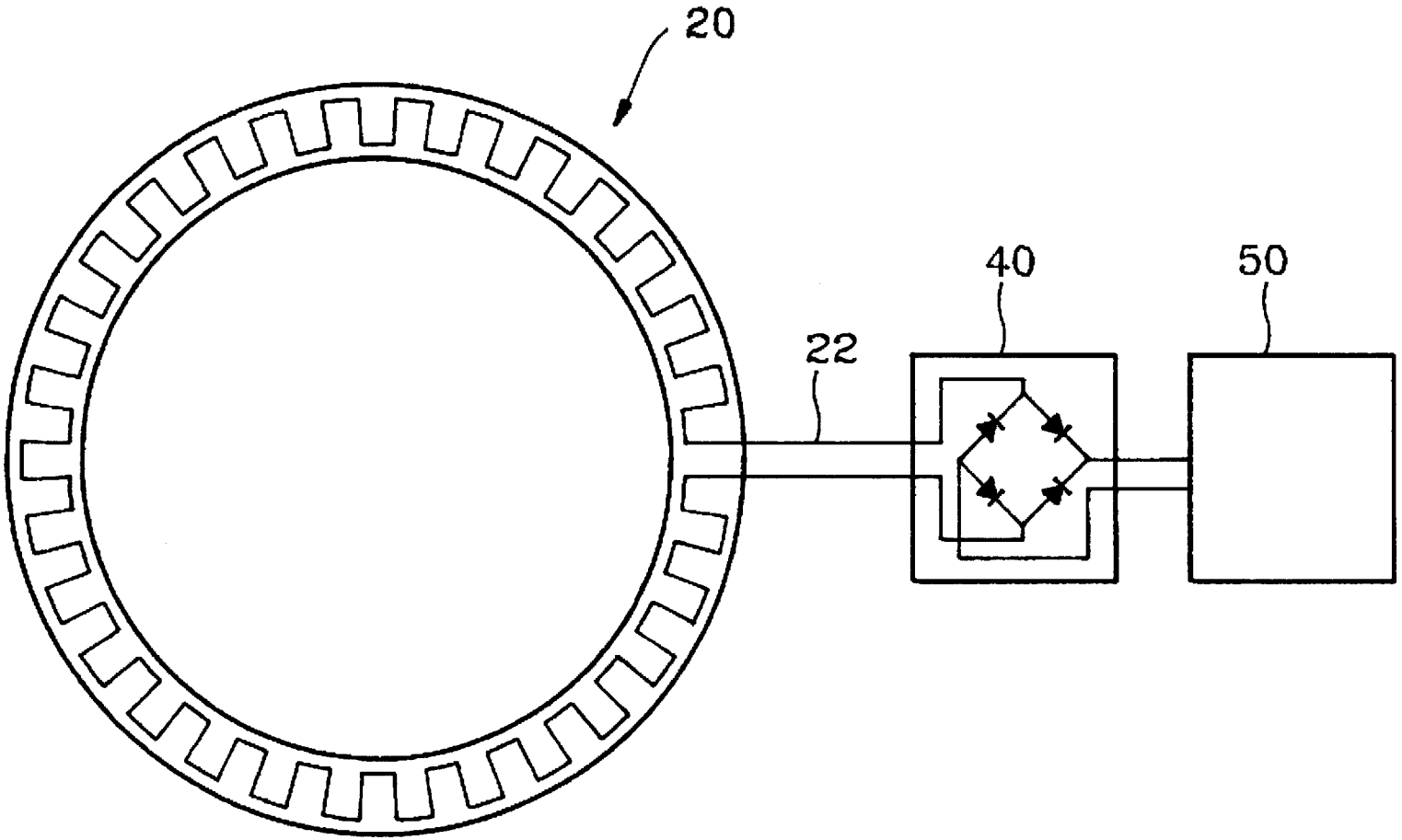
FIG. 5 illustrates the generator of the present invention, which is connected electrically with a rectifier and a capacitor.
Figure 6:
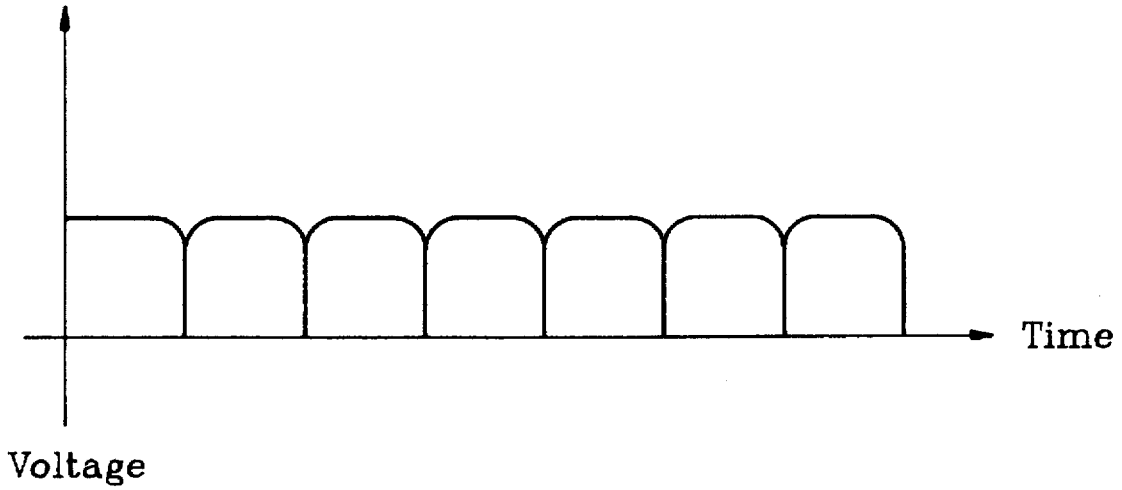
FIG. 6 illustrates an example of the voltage wave form from the generator after being rectified.

Referring to FIG. 5, the lead-out wires 22 of the generator 2 are connected with a rectifier 40 for converting the induction current into direct current; the rectifier is a conventional bridge rectifier; a capacitor 50 is used for storing the direct current. The output voltage after the rectifier will be a steady direct current as shown in FIG. 6.

Figure 7:
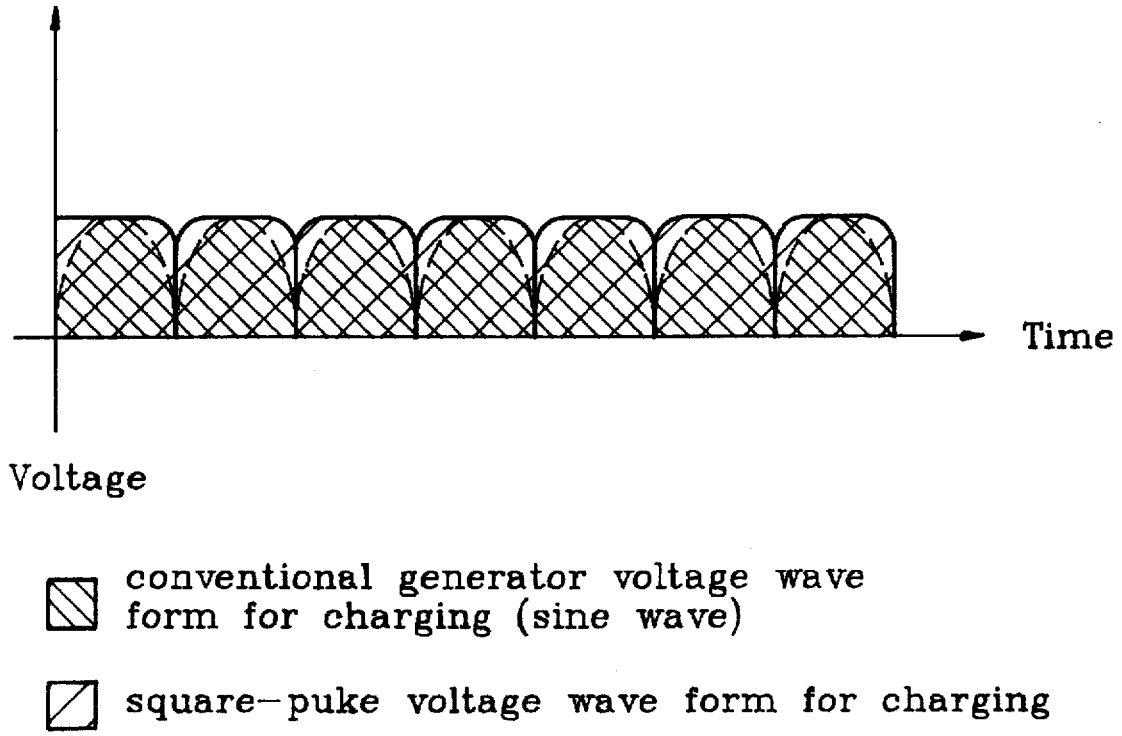
FIG. 7 is a comparison view between the output voltage rectified according to the present invention and a voltage wave form generated with a conventional generator.

Referring to FIG. 7, the present invention has been compared with the effective value of the induction electro-motive force a conventional generator; it is apparent that the effective value is higher than that of the conventional generator.

In brief, the generator according to the present invention has advantages as follows:

(1). It needs no acceleration gears, and therefore the size of the generator can be reduced.

(2). The electro-motive force generated with the present invention is a square pulse wave form so as to provide a better efficiency (i.e., a higher effective value).

The aforesaid description is a preferred embodiment of the present invention, which has the prime features of the present invention, but it is not construed as a limitation to the present invention; the scope of the present invention is to be defined with the claims of the present invention.

We claim:

1. A swinging type generator comprising:

(a) a base with a shaft hole in a center thereof;

(b) at least a stator mounted on said base; wherein said stator includes at least one layer of ring-shaped coil plate having at least one square-wave-shaped induction coil arranged on and along a circumference of said ring-shaped coil plate, and a pair of lead-out wires connected to output terminals of said induction coil;

(c) an unbalanced-and-weighted swinging magnetic rotor having a rotary shaft in a center thereof; wherein said rotary shaft is mounted in said shaft hole of said base, said unbalanced-and-weighted swinging magnetic rotor includes a magnetic ring having a plurality of magnets arranged in a head-to-tail manner along a circumference of said magnetic ring; and (d) an air gap axially provided between said unbalanced-and-weighted swinging magnetic rotor and said stator so as to allow them to rotate relative thereto;

(e) wherein said magnets of said magnetic ring and said induction coil are arranged such that when said unbalanced-and-weighted swinging magnetic rotor is swung, said induction coil is caused to cut through lines of magnetic forces produced by said magnetic ring so as to generate an induction electro-motive force;

(f) further wherein said square-wave-shaped induction coil has a coil angle, which is an angle formed between an ascending portion and a descending portion of said square wave with respect to said center of said shaft hole, equaling a magnet angle, which is an angle formed between half of the arc length of an individual magnet of said magnetic ring and said center of said shaft hole.

2. A swinging type generator as claimed in claim 1, wherein said induction coil arranged on said ring-shaped coil plate is formed by means of an etching method.

3. A swinging type of generator as claimed in claim 1, wherein said stator includes a plurality of said coil plates each having at least one said periodic-wave-shaped induction coil, and said induction coils are connected in series so as to increase the electro-motive force that can be generated.

4. A swinging type of generator as claimed in claim 1, wherein said lead-out wires of said stator are connected with a rectifier and capacitor so as to allow electric energy to be stored in said capacitor.

* * * * *